US007645012B2

(12) United States Patent
Ikeda

(10) Patent No.: US 7,645,012 B2
(45) Date of Patent: Jan. 12, 2010

(54) RECORDING APPARATUS

(75) Inventor: Yasuhiko Ikeda, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 159 days.

(21) Appl. No.: 11/537,827

(22) Filed: Oct. 2, 2006

(65) Prior Publication Data

US 2007/0076037 A1 Apr. 5, 2007

(30) Foreign Application Priority Data

Oct. 3, 2005 (JP) ..... 2005-290008

(51) Int. Cl.
*B41J 29/38* (2006.01)

(52) U.S. Cl. ..... 347/16; 347/5; 347/9

(58) Field of Classification Search ..... 347/5, 347/9, 14, 16, 19; 399/82
See application file for complete search history.

(56) References Cited

U.S. PATENT DOCUMENTS 5,946,527 A * 8/1999 Salgado et al. ..... 399/82

FOREIGN PATENT DOCUMENTS

JP 4-158078 1/1992

* cited by examiner

*Primary Examiner*—Lam S Nguyen
(74) *Attorney, Agent, or Firm*—Canon USA Inc IP Div

(57) ABSTRACT

A recording apparatus includes a recording head, a sheet feed section configured to feed loaded recording sheets one by one toward the recording head, a carriage moving along a recording sheet and mounting the recording head thereon, a first detection unit configured to detect the width of the loaded recording sheet, and a second detection unit arranged in the carriage and configured to detect the width of the recording sheet as the carriage moves along the recording sheet. A detection area of the second detection unit is set based on the width of the loaded recording sheet detected by the first detection unit.

10 Claims, 10 Drawing Sheets

E0011
CONTACT FPC
S1100
E0012
CRFFC
CRPCB
E0013
ENCODER SCALE
E0005
E0002
LF MOTOR
E0008
GAP SENSOR
E0004
ENCODER SENSOR
E0006
INK END SENSOR
COVER SENSOR
E0022
RESUME KEY
E0019
LED
E0020
E0018
POWER KEY
MAIN PCB
E0016
PARALLEL INTERFACE
E0017
SERIAL INTERFACE
E0014
E0021
BUZZER
ASF SENSOR
E0009
PE SENSOR
E0007
E0015
POWER SUPPLY UNIT
E0001
CR MOTOR
E0003
PG MOTOR
PG SENSOR
E0010
E0023
ASF MOTOR

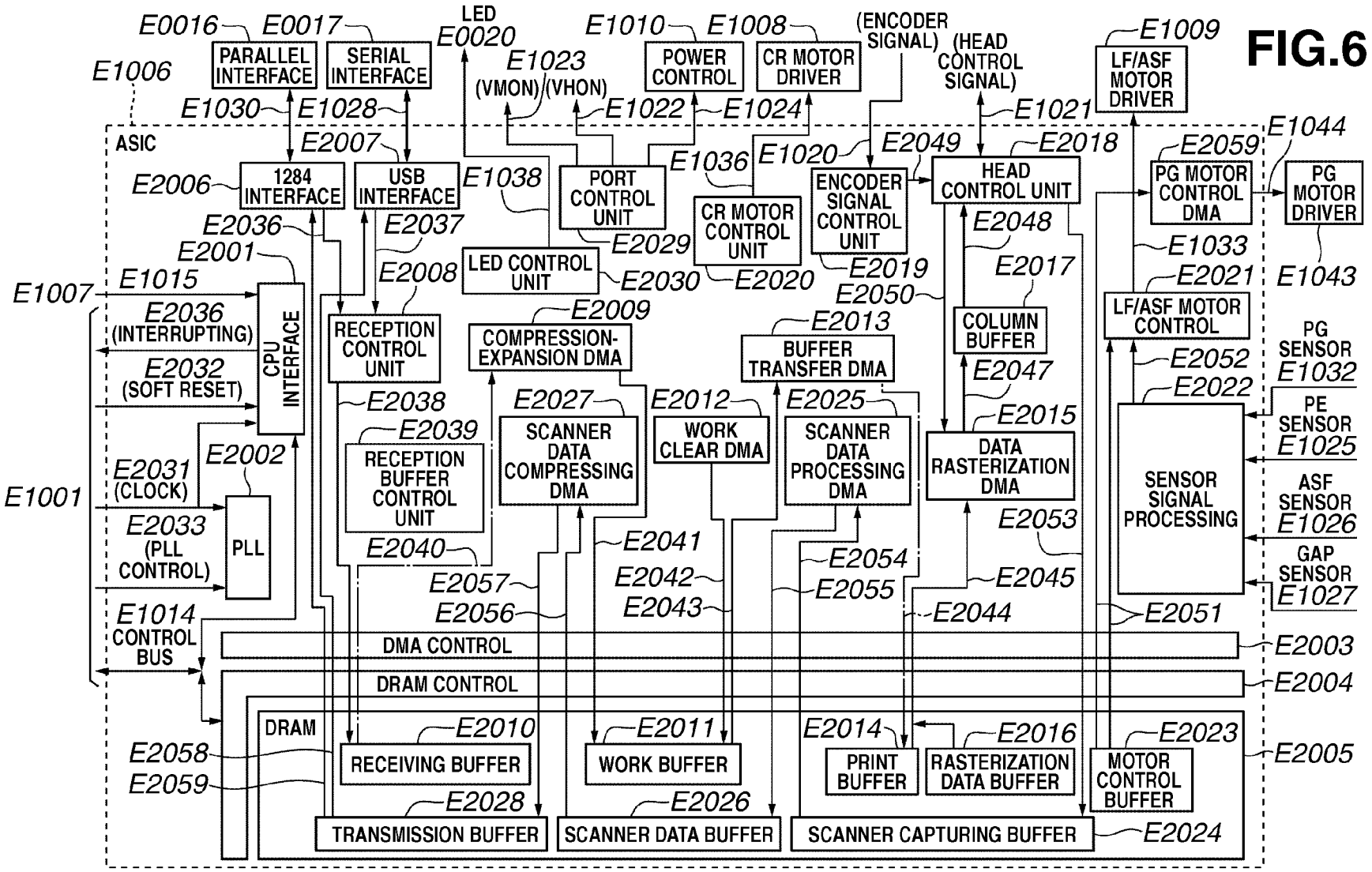
FIG.6
PG MOTOR DRIVER
PG SENSOR
PE SENSOR
ASF SENSOR
GAP SENSOR
LF/ASF MOTOR DRIVER
PG MOTOR CONTROL DMA
LF/ASF MOTOR CONTROL
SENSOR SIGNAL PROCESSING
MOTOR CONTROL BUFFER
HEAD CONTROL UNIT
(HEAD CONTROL SIGNAL)
COLUMN BUFFER
DATA RASTERIZATION DMA
RASTERIZATION DATA BUFFER
SCANNER CAPTURING BUFFER
(ENCODER SIGNAL)
ENCODER SIGNAL CONTROL UNIT
BUFFER TRANSFER DMA
SCANNER DATA PROCESSING DMA
PRINT BUFFER
CR MOTOR DRIVER
CR MOTOR CONTROL UNIT
WORK CLEAR DMA
POWER CONTROL
PORT CONTROL UNIT
LED CONTROL UNIT
COMPRESSION-EXPANSION DMA
SCANNER DATA COMPRESSING DMA
WORK BUFFER
SCANNER DATA BUFFER
(VHON)
(VMON)
LED
SERIAL INTERFACE
USB INTERFACE
RECEPTION CONTROL UNIT
RECEPTION BUFFER CONTROL UNIT
DMA CONTROL
DRAM CONTROL
RECEIVING BUFFER
TRANSMISSION BUFFER
PARALLEL INTERFACE
1284 INTERFACE
CPU INTERFACE
PLL
DRAM
ASIC
(INTERRUPTING)
(SOFT RESET)
(CLOCK)
(PLL CONTROL)
CONTROL BUS
E1001
E1006
E1007
E1009
E1008
E1010
E1014
E1015
E1020
E1021
E1022
E1023
E1024
E1025
E1026
E1027
E1028
E1030
E1032
E1033
E1036
E1038
E1043
E1044
E0016
E0017
E0020
E2001
E2002
E2003
E2004
E2005
E2006
E2007
E2008
E2009
E2011
E2012
E2013
E2014
E2015
E2016
E2017
E2018
E2019
E2020
E2021
E2022
E2023
E2024
E2025
E2026
E2027
E2028
E2029
E2030
E2031
E2032
E2033
E2036
E2037
E2038
E2039
E2040
E2041
E2042
E2043
E2044
E2045
E2047
E2048
E2049
E2050
E2051
E2052
E2053
E2054
E2055
E2056
E2057
E2058
E2059

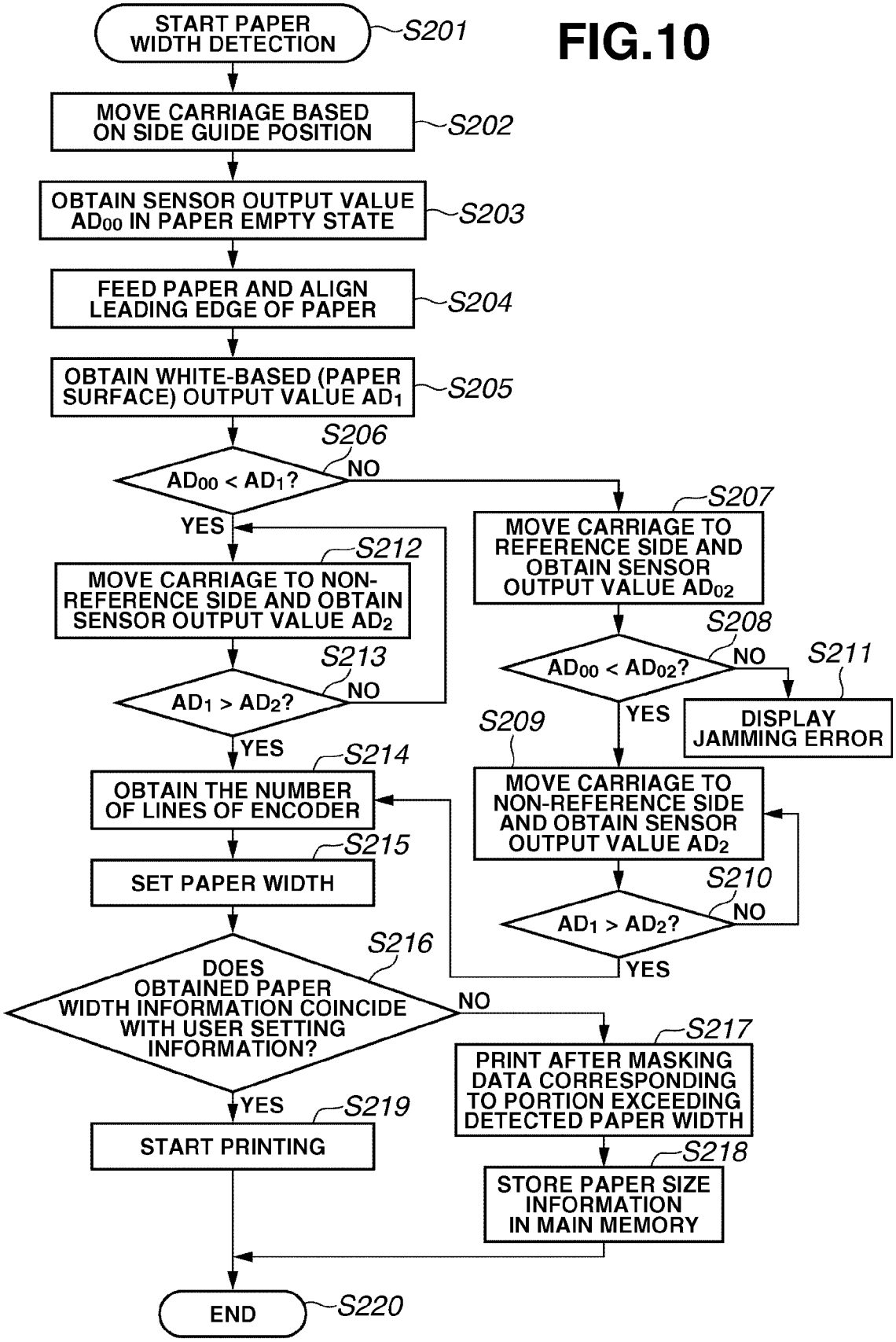
FIG.10
START PAPER WIDTH DETECTION
S201
MOVE CARRIAGE BASED ON SIDE GUIDE POSITION
S202
OBTAIN SENSOR OUTPUT VALUE AD00 IN PAPER EMPTY STATE
S203
FEED PAPER AND ALIGN LEADING EDGE OF PAPER
S204
OBTAIN WHITE-BASED (PAPER SURFACE) OUTPUT VALUE AD1
S205
S206
AD00 < AD1?
NO
YES
S207
MOVE CARRIAGE TO REFERENCE SIDE AND OBTAIN SENSOR OUTPUT VALUE AD02
S212
MOVE CARRIAGE TO NON-REFERENCE SIDE AND OBTAIN SENSOR OUTPUT VALUE AD2
S208
AD00 < AD02?
NO
S211
DISPLAY JAMMING ERROR
S213
AD1 > AD2?
NO
YES
S209
YES
S214
OBTAIN THE NUMBER OF LINES OF ENCODER
MOVE CARRIAGE TO NON-REFERENCE SIDE AND OBTAIN SENSOR OUTPUT VALUE AD2
S215
SET PAPER WIDTH
S210
AD1 > AD2?
NO
YES
S216
DOES OBTAINED PAPER WIDTH INFORMATION COINCIDE WITH USER SETTING INFORMATION?
NO
S217
PRINT AFTER MASKING DATA CORRESPONDING TO PORTION EXCEEDING DETECTED PAPER WIDTH
YES
S219
START PRINTING
S218
STORE PAPER SIZE INFORMATION IN MAIN MEMORY
END
S220

RECORDING APPARATUS

BACKGROUND OF THE INVENTION

1. Field of the Invention

The present invention relates to a recording apparatus for forming an image on a recording sheet based on image information by a recording head.

2. Description of the Related Art

A recording apparatus forms an image on a recording sheet such as a recording paper based on image information, and is widely used as a printer, a facsimile machine, a copier, and a multifunction peripheral and system having these functions. The term "image" in the present specification is not limited to an image in its narrow sense, but includes all recordable images such as a character and a symbol, and the terms "image information" and "image data" are defined similarly in its broad sense. Recently, with rapid popularization of personal computers, the image information comes to be easily handled, and a demand for a simple recording apparatus for outputting the image information is increasing. As the recording method used in the recording apparatus, there are various methods such as an inkjet method, a laser beam method, a heat-transfer method, a thermal method, and a wire-dot method. Among these methods, the recording apparatus adopting the inkjet method is relatively compact and inexpensive, and moreover, enables realizing highly refined recording.

Particularly in the inkjet recording apparatus, in a case where a recording head is mounted on a carriage, ink discharge in a recording operation has to be performed within a scanning range of the carriage. However, in a case where the recording sheet set in the apparatus is smaller than the scanning range of the carriage, and the recording data is set that exceeds a size of the recording sheet, the ink is discharged beyond a width of the recording sheet.

In such a situation, there arises a problem in that ink smears the inside of the apparatus, which smears the subsequent recording sheet or the hands of the user who operates the apparatus. Further, recording time is uselessly spent by the movement of the carriage which is unnecessary for the recording operation, so that throughput is reduced. In order to avoid such problem, a width of the recording sheet is detected. For example, Japanese Patent Application Laid-Open No. 4-158078 discusses a technique in which a reflective sensor is provided on the carriage and the carriage is moved over the sheet in the width direction from end to end to detect the change of the sensor output, so that the width of the recording sheet can be determined.

However, according to the above conventional technique in which the sheet width is detected by the sensor mounted on the carriage, the following problems arise. First, a wide area on the recording sheet has to be scanned, and thus it takes a long time to complete the detection, which reduces throughput. Second, there is a problem in that it is impossible to detect the sheet width unless the recording sheet is fed, and accordingly the technique cannot be utilized in a printer driver configured to form the image information before starting the sheet feeding.

SUMMARY OF THE INVENTION

The present invention is directed to a recording apparatus capable of accurately detecting a sheet width in a simple configuration and in the short period of time.

According to an aspect of the present invention, a recording apparatus includes: a carriage moving along a recording sheet and mounting the recording head thereon; a sheet feed section configured to feed loaded recording sheets one by one toward the recording head a first detection unit configured to detect a width of the loaded recording sheet; and a second detection unit arranged in the carriage and configured to detect a width of the recording sheet as the carriage moves along the recording sheet, wherein a detection area of the second detection unit is set based on the width of the loaded recording sheet detected by the first detection unit.

Further features of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 6 is a block diagram showing a configuration of an application specific integrated circuit (ASIC) of the main PCB (printed circuit board) shown in FIG. 5.

FIG. 10 is a flowchart showing another sequence when the width of the recording sheet is detected according to the embodiment of the present invention.

DETAILED DESCRIPTION OF THE EMBODIMENTS

Embodiments of the invention will be described in detail below with reference to the drawings.

Figure 1:
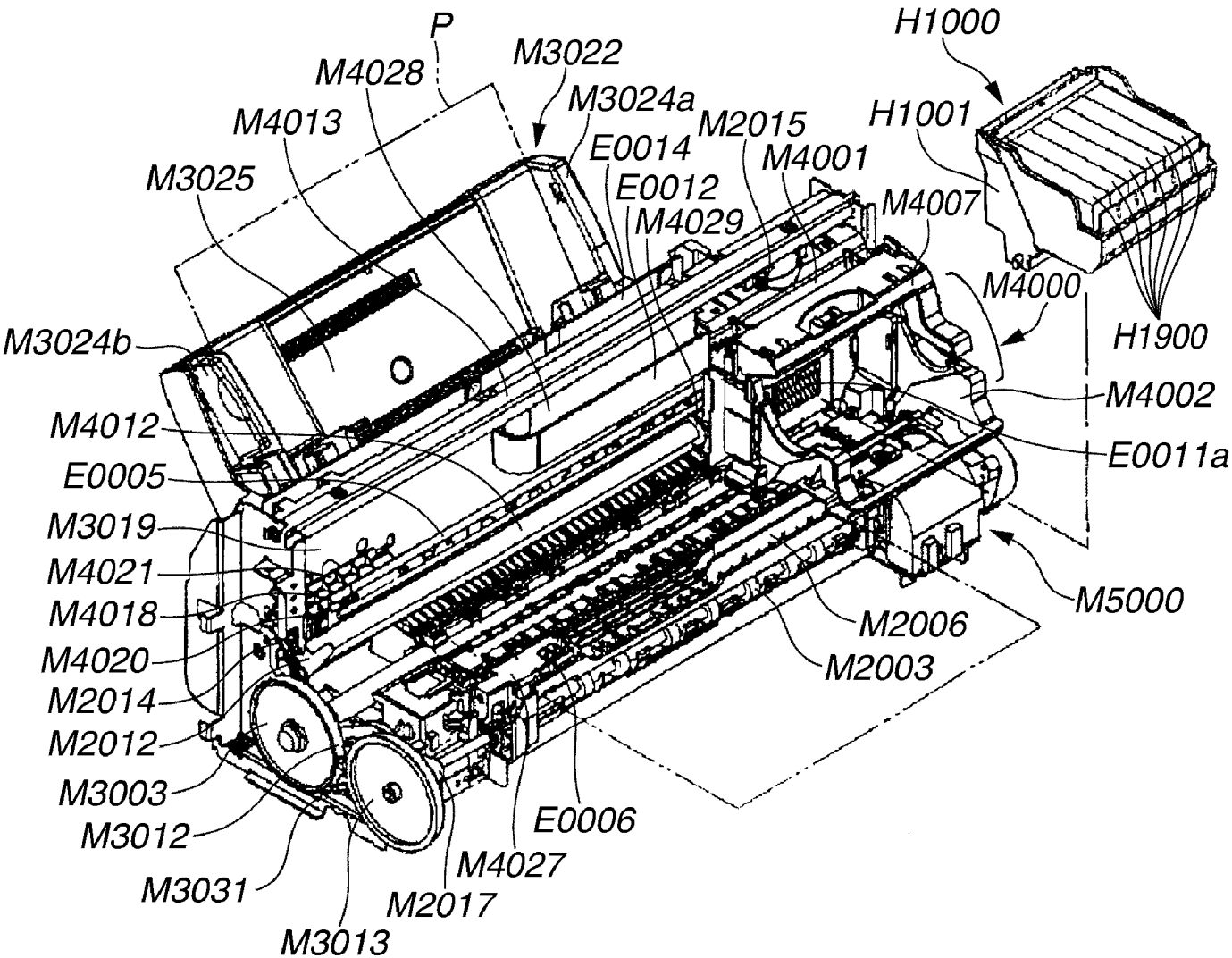
FIG. 1 is a perspective view showing a recording apparatus according to one embodiment with an exterior package removed.
Figure 2:
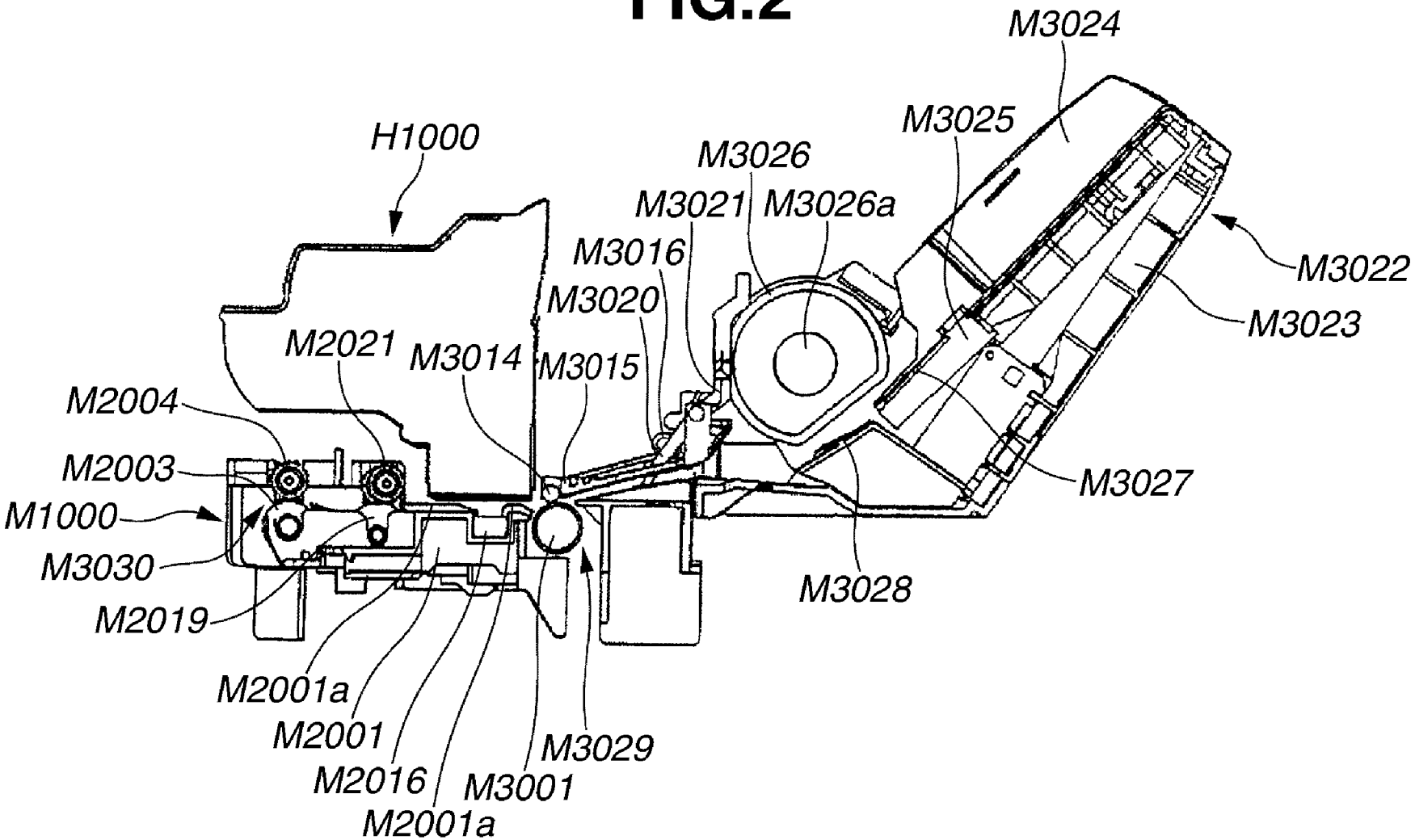
FIG. 2 is a longitudinal sectional view showing a configuration of the recording apparatus of FIG. 1.

FIG. 1 is a perspective view showing a recording apparatus according to one embodiment with an exterior package removed. FIG. 2 is a longitudinal sectional view showing a configuration of the recording apparatus of FIG. 1. In the present embodiment, an inkjet recording apparatus is described as an example of the recording apparatus. In FIGS. 1 and 2, a chassis M3019 forming a framework of an apparatus main body is configured by a plurality of sheet metal members having a predetermined rigidity, and holds each section of the recording apparatus as described below. The recording apparatus includes a sheet feed section M3022, a sheet conveyance section M3029, a sheet discharge section M3030, an image forming section M4000, and a recovery section M5000. The "image" as described above, includes all recordable images including characters, and symbols.

The sheet feed section M3022 separates loaded recording sheets P one by one and feeds them into the apparatus main body. The sheet conveyance section M3029 conveys the recording sheets fed from the sheet feed section M3022 through the recording position, and discharges the recording sheets carrying the recorded images outside of the main body in collaboration with the sheet discharge section M3030. The image forming section M4000 includes a recording head H1001 for recording a desired image on the recording sheets conveyed by the sheet conveyance section M3029. In the image forming section of the present embodiment, recording is performed by the recording head H1001 mounted on a carriage M4001, which can reciprocate along the recording sheet. The recovery section M5000 performs recovery processing of the recording head H1001.

Figure 8:
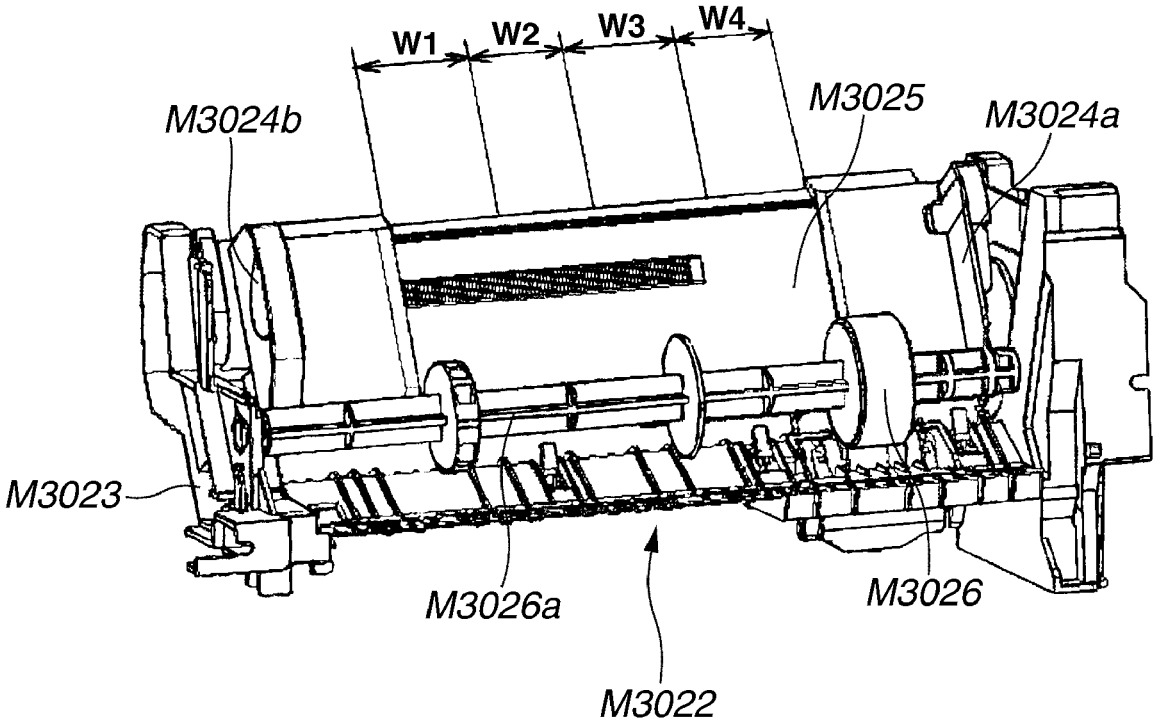
FIG. 8 is a front perspective view showing a sheet feed section of the recording apparatus of FIG. 1 together with a sheet width detection area detectable by a movable side guide.

A configuration and an operation of each section of the apparatus will be described below. The sheet feed section M3022 sends out horizontally a recording sheet P that is loaded on a pressure plate M3025 at an angle of approximately 30 to 60 degrees with respect to a horizontal plane, and feeds the sheet into the apparatus main body while maintaining an approximately horizontal state from a sheet feed port (not shown). FIG. 8 is a perspective view showing a configuration of a sheet feed section of the recording apparatus of FIG. 1 together with a sheet width detection area detectable by a movable side guide. In FIGS. 1, 2, and 8, the sheet feed section M3022 includes a sheet feed roller M3026 and a sheet guide M3024 having a reference side guide M3024*a* and a movable side guide M3024*b*. The sheet feed section M3022 is provided with the pressure plate M3025, a base section M3023, a separation sheet M3027, and a separation pad M3028.

The base section M3023 is equivalent to an outside shell of the sheet feed section M3022, and is provided on the rear side of the apparatus main body. The pressure plate M3025 supporting the recording sheet at an angle of approximately 30 to 60 degrees with respect to a horizontal plane is attached on the front side of the base section M3023. Further, the sheet guide M3024 including the pair of side guides 3024*a* and 3024*b* that guide both side edges of the recording sheet P, is protruded to the front side of the base section M3023. One sheet guide M3024*a* is a reference side guide fixed at a definite position, and the other side guide M3024*b* is a movable side guide moving in the sheet width direction.

These side guides M3024*a* and M3024*b* function as a guide unit for controlling positions of the recording sheets P of various sizes (width) in the sheet width direction. Further, in order to detect the position of the movable side guide M3024*b*, a sensor which serves as a first detection unit, is arranged between the base portion M3023 and the pressure plate M3025. In the present embodiment, this sensor is arranged at three places in the sheet width direction, and can detect four sheet width areas (positions) indicated by W1, W2, W3, and W4 in FIG. 8. As a sensor serving as the first detection unit, sensors of various detection methods can be used if they can detect the position of the movable side guide M3024*b* in the sheet width direction with respect to the reference side guide M3024*a*. For example, the sensors employing an electric contact method, a magnetic sensing method, a light transmittance blocking method, an encoder method, or a light reflection type, can be used.

A driving shaft M3026*a* driven by a sheet feed motor via a transmission gear train is pivotally supported at left and right sides of the base section M3023. The sheet feed roller M3026 having an anomalous peripheral surface is fixed at plural positions in the sheet width direction of the driving shaft M3026*a*. The recording sheets P loaded on the pressure plate M3025 are separated and sent out one by one from the top through the separation sheet M3027 and the separation pad M3028 while the sheet feed roller M3026 is rotated by the sheet feed motor. Then, the recording sheets P are fed to the sheet conveyance section M3029. The lower end of the pressure plate M3025 is elastically supported by a spring attached between the pressure plate M3025 and the base section M3023. Hence, a contact pressure between the sheet feed roller M3026 and the recording sheet is maintained approximately at a constant level regardless of the number of loaded recording sheets P.

Figure 3:
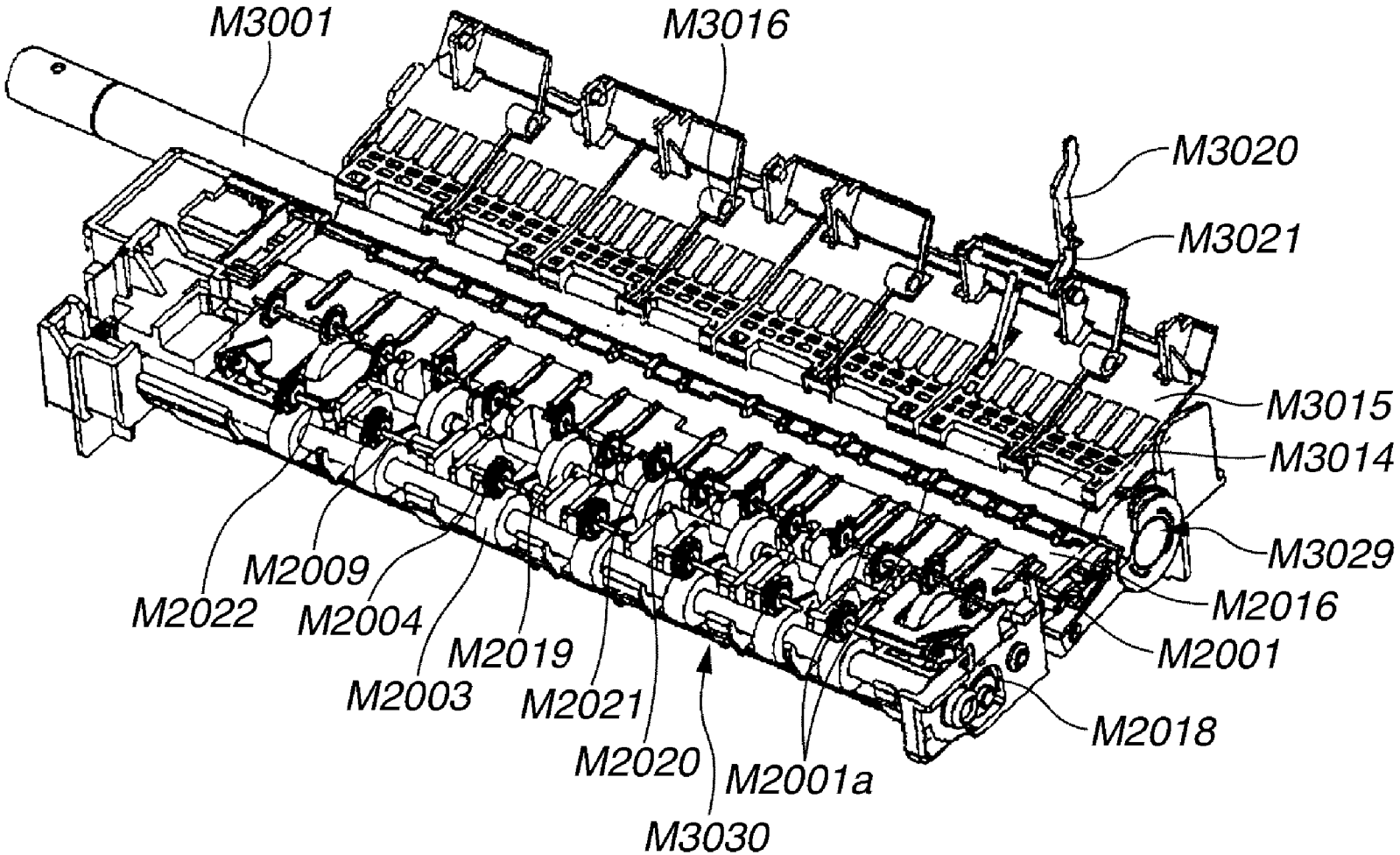
FIG. 3 is a perspective view showing a sheet conveyance section and a sheet discharge section of the recording apparatus of FIG. 1.

FIG. 3 is a perspective view showing the sheet conveyance section M3029 and the sheet discharge section M3030 of the recording apparatus of FIG. 1. In the conveyance route from the sheet feed section M3022 to the sheet conveyance section M3029, a sheet end detection lever (PE lever) M3020 is provided being biased in a predetermined direction (counterclockwise direction in FIG. 2) by a spring M3021. The sheet end detection lever M3020 is pivoted about a pinch roller holder M3015 including a sheet member made of metal having a predetermined rigidity. The pinch roller holder M3015 is attached to the chassis M3019.

The recording sheet separated and fed from the sheet feed section M3022 advances into the sheet conveyance route. When the leading edge of the sheet pushes and rotates one end of the sheet end detection lever M3020, a sheet end sensor (PE sensor) (not shown) detects this rotation, and senses that the recording sheet enters the conveyance route. When the sheet end sensor detects the recording sheet that enters the conveyance route, the recording sheet is conveyed to the down stream side by the sheet feed roller M3026 by the predetermined conveyance amount. Being conveyed by the sheet feed roller M3026, the leading edge of the recording sheet abuts against a conveyance roller (LF roller) M3001 and a nip portion of the pinch roller M3014, and the recording sheet stops in a state bent by the predetermined amount. The bending amount (size of a loop) at this time is, for example, approximately 3 mm.

The sheet conveyance section M3029, as shown in FIGS. 1 to 3, includes the conveyance roller M3001, the pinch roller M3014, a platen M2001 and a platen absorber M2016. The conveyance roller M3001 is rotatably supported via a bearing. A conveyance gear (LF gear) M3003 is fixed at one end of the conveyance roller M3001, and the conveyance gear M3003 is engaged with a motor gear M3031 of the output shaft of the conveyance motor via a conveyance intermediate gear M3012. That is, the conveyance roller M3001 is rotated via the gear train by the rotation of the conveyance motor.

The pinch roller M3014 is pivoted around the top end of the pinch roller holder M3015 which is rotatably supported by the chassis M3019. The pinch roller M3014 is pressed to the conveyance roller M3001 by a spring M3016 which biases the pinch roller holder M3015. When the conveyance roller M3001 rotates, the pinch roller M3014 is also driven to rotate. Then, the recording sheet P stopped in a loop state is conveyed to the down stream side, while the sheet P is sandwiched by the conveyance roller M3001 and the pinch roller M3014.

The center of the pinch roller M3014 is offset approximately 2 mm to the down stream side in the conveyance direction from the center of the conveyance roller M3001. In this manner, the recording sheet P conveyed by the conveyance roller M3001 and the pinch roller M3014 is conveyed along a sheet carrying surface M2001*a* of the platen M2001. In the conveyance section thus configured, when a definite period of time passes after the sheet feed operation by the sheet feed roller M3026 is stopped, driving of the conveyance motor is started. The driving force of the conveyance motor is transferred to the conveyance roller M3001 via the intermediate gear M3012 and the conveyance gear M3003. The leading edge of the recording sheet P abuts against the nip portions of the conveyance roller M3001 and the pinch roller M3014, and the recording sheet P is conveyed to a recording starting position on the platen M2001.

During this conveyance, the sheet feed roller M3026 starts again a rotation together with the conveyance roller M3001, and the recording sheet P is conveyed to the down stream side being driven by both rollers for a predetermined period of time. A head cartridge H1000 is mounted on the carriage M4001 which reciprocates in a direction (for example, orthogonal direction) intersecting with the conveyance direction along a carriage shaft M4012. The head cartridge H1000 discharges ink to the recording sheet that is waiting at a recording starting position, so as to form an image. After the image is formed, the recording sheet is conveyed by the predetermined amount by the rotation of the conveyance roller M3001, for example, it is conveyed 5.42 mm per line at a time. After this conveyance is completed, the carriage M4001 performs main scanning so that one line is recorded. By alternatively repeating this conveyance per line at a time and the recording of one line, an image is recorded on the entire recording sheet P.

Both ends of the carriage shaft M4012 are arranged on an inter-sheet adjustment plate M2012 fixed to the chassis M3019 being biased through springs M2014. This inter-sheet adjustment plate is configured to adjust a gap between the discharge surface of the recording head H1001 and a support surface M2001*a* of the platen M2001, to an appropriate value. When an inter-sheet adjustment lever is moved to one position, the carriage M4001 is set to a position approximately 0.6 mm away from the platen M2001. In a case where the recording sheet is thick like an envelope, the inter-sheet adjustment lever is moved to a predetermined position in advance, and the sheet feed operation by the automatic sheet feed section M3022 is started.

Further, the gap between the recording head H1001 and the platen M2001 is detected by a GAP sensor. When the sheet feed operation is started, it is determined whether the position setting of the inter-sheet adjustment lever M2015 is appropriate, based on the output of the GAP sensor. In a case where an inappropriate state is detected, a warning is issued as a display message or buzzer. In this manner, the recording operation in an inappropriate state can be prevented in advance.

The sheet discharge section M3030 is disposed at the downstream side in the conveyance direction of the platen M2001, and includes a first discharge roller M2003, a first spur M2004, a second discharge roller M2019, a second spur M2021, and a spur base M2006. The first discharge roller M2003 is pivoted to the platen at one end, and is pivoted to the chassis M3019 via the bearing M2017 at the other end. The first discharge roller M2003 is provided with a discharge gear M3013 at its one end, and is rotationally driven together with the conveyance roller M3001 while the driving force of the conveyance motor is transferred to a discharge gear via the intermediate gear M3012. The second discharge roller M2019 is disposed at the upstream side in the conveyance direction of the first discharge roller M2003. The second discharge roller M2019 is provided with a transmission gear at one end. The rotation of the first discharge roller M2003 is transferred via the intermediate gear M2018 to rotationally drive the second discharge roller M2019 at the same time.

The first spur M2004 and the second spur M2021 are attached to the spur base M2006. The first spur M2004 is pressed to the first discharge roller M2003 by a biasing force of a spring shaft M2009 attached to the spur base. The first spur M2004 is driven to rotate in accordance with the rotation of the first discharge roller M2003 and thus, generates a conveyance force. The second spur M2021 is pressed to the second discharge roller M2019 by a biasing force of a spring shaft M2020 attached to the spur base. The second spur M2021 is driven to rotate in accordance with the rotation of the first discharge roller M2019, and thus, generates a conveyance force. The recording sheet with the recorded image is discharged to a discharge tray (not shown) by the discharge rollers and spurs.

Here, the rotational center of the second spur M2021 is offset approximately 2 mm away from the rotational center of the second discharge roller M2019 to the up stream side in the conveyance direction. Hence, the recording sheet conveyed by the second discharge roller M2019 and the second spur M2021 is brought into contact lightly with the support surface M2001*a* of the platen M2001 without gap, so that the recording sheet is appropriately and smoothly conveyed. Conveyance speed of the first discharge roller M2003 and the second discharge roller M2019 is almost the same as the conveyance speed of the conveyance roller M3001. However, in order to prevent slackening of the recording sheet, the conveyance speed of the former may be set to be slightly higher.

Between the first spur M2004 and the second spur M2021, there is provided a third spur M2022 not opposing the discharge roller. The third spur M2022 forms a light and irregular wave on the recording sheet, so that the expansion of the recording sheet caused by the recording is absorbed, and a contact between the recording head H1000 and the recording sheet is prevented. When an image recording on the recording sheet P is completed, the trailing end of the recording sheet gets out in due time from between the conveyance roller M3001 and the pinch roller M3014. Then, the conveyance of the recording sheet only by the first discharge roller M2003 and the first spur M2004 as well as the second discharge roller M2019 and the second spur M2021 is performed, and the discharge of the recording sheet is completed.

The image forming section M4000 includes the carriage M4001 and the head cartridge H1000. The carriage M4001 is movably guided and supported by the carriage shaft M4012. The head cartridge H1000 is detachably mounted on the carriage M4001, and includes an ink tank H1900 and the recording head H1001. The ink tank H1900 stores ink used for recording. The recording head H1001 records an image by selectively discharging the ink supplied by the ink tank H1900 from a plurality of discharge ports according to image information. The head cartridge H1000 shown in FIG. 1 is capable of performing high image quality color recordings in a photographic tone. As the ink tank H1900, for example, the independent ink tanks of black, light cyan, light magenta, cyan, magenta, and yellow are used respectively. These ink tanks can be detachably attached to the recording head H1001.

The recording head H1001 is positioned and attached by a head set lever M4007 in a pressed state to the carriage M4001. A coupling portion of the recording head H1001 with the carriage M4001 is provided with a contact flexile print cable (contact FPC). A contact portion E0011*a* on the contact FPC and a contact portion (external signal input terminal) provided in the recording head H1001 is electrically connected, through which various types of information for recording are given and received, and the power is supplied to the recording head H1001. Between the contact portion of the contact FPC and the carriage M4001, an elastic member such as rubber is provided, which enables a reliable contact between the contact portion and the recording head.

The contact FPC is connected to a carriage PCB E0013 mounted on the back of the carriage M4001. The carriage PCB E0013 is electrically connected to a main PCB E0014 provided in a chassis M3019 by a carriage flexible flat cable (carriage FFC) E0012. That is, the other end of the carriage (FFC) E0012 is fixed to the chassis M3019 by a FFC presser M4028, and at the same time, is guided to the back side of the chassis M3019 through a hole (not shown) provided in the chassis M3019, and is connected to the main PCB E0014.

The carriage PCB E0013 is provided with an encoder sensor E0004. An encoder scale E0005 is spanned in parallel with the carriage shaft M4012 between side plates of both sides of the chassis M3019. Information on the encoder scale E0005 is detected by the encoder sensor E0004, so that the position and the scanning velocity of the carriage M4001 are detected. In the present embodiment, the encoder sensor E0004 can be an optical transmission sensor. The encoder scale E0005 is formed in such a manner that a light shielding portion for shielding a detection light from the encoder sensor E0004, and a transmission portion of the detection light are alternatively printed on the film made of resin such as polyester at a predetermined pitch using, for example, a photo engraving technique.

The carriage M4001 performs scanning by being guided by the carriage shaft M4012 and the carriage lever M4013 which are spanned between both side plates of the chassis M3019. The position of the carriage M4001 on the carriage shaft M4012 is measured by abutting the carriage M4001 onto one side plate of the chassis M3019 and taking the abutted position as a reference. That is, along with the scanning of the carriage M4001 from the abutted position, a number of patterns formed in the encoder scale E0005 is calculated by the encoder sensor E0004 so that the position of the carriage M4001 can be detected at any time.

The carriage M4001 is connected to a carriage belt M4018 which is spanned between an idler pulley M4020 and a motor pulley (not shown). The carriage motor drives the motor pulley to rotate and move the carriage belt M4018, so that the carriage M4001 moves scanning along the carriage shaft M4012. The motor pulley is held at a fixed position, while the idler pulley M4020 is movably held to the chassis M3019 together with the pulley holder M4021. The idler pulley M4020 is biased by a spring in a direction of isolating itself from the motor pulley. The carriage belt M4018 spanned between both pulleys is given an appropriate tensile force, and a good spanning state without slackening is maintained.

An ink end sensor E0006 is provided on a scanning track of the carriage M4001 of the spur base M2006. The ink end sensor E0006 detects the remaining amount of the ink stored in the ink tank H1900 of the head cartridge H1000 attached to the carriage M4001, and is exposed and opposed to the ink tank H1900. The ink end sensor E0006 is housed in a sensor cover M4027 which can shut off the noises from the outside with a metal plate and the like in order to prevent malfunction of the sensor.

The recovery section M5000 performs a recovery processing for recovering and maintaining a discharge performance of the head cartridge H1000, and is configured by a recovery system unit detachably attached to the apparatus main body M1000. This recovery system unit includes a cleaning unit and a recovery unit. The cleaning unit removes foreign matter adhered to a recording element PCB of the recording head H1001, and the recovery unit normalizes a channel of ink flow from the ink tank H1900 to the recording element PCB of the recording head H1001.

Figure 4:
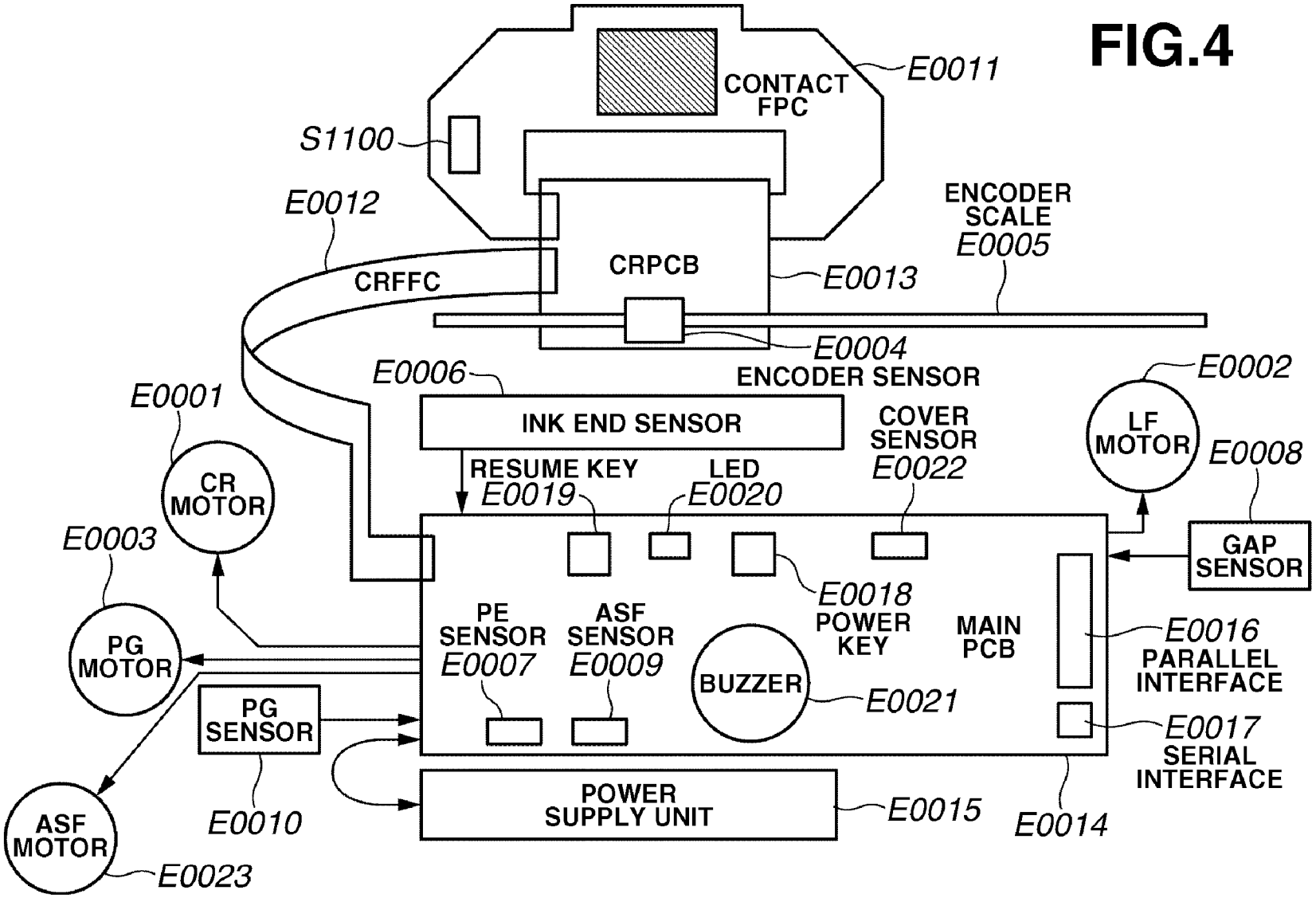
FIG. 4 is a block diagram showing a configuration of an electrical circuit of the recording apparatus of FIG. 1.

FIG. 4 is a block diagram showing a configuration of an electrical circuit of the recording apparatus of FIG. 1. Next, the electrical circuit of the recording apparatus according to one embodiment will be described. The electrical circuit of FIG. 4 mainly includes the carriage PCB (CRPCB) E0013, the main PCB (Printed Circuit Board) E0014, and a power supply unit E0015. The power supply unit E0015 is connected to the main PCB E0014 to supply the driving power of various types. The carriage PCB E0013 is mounted on the carriage M4001 and functions as the interface for receiving and giving signals from and to the recording head H1001 through a contact flexible printer cable (FPC) E0011. This carriage PCB E0013 detects a change in the positional relationship between the encoder scale E0005 and the encoder sensor E0004 based on the pulse signal which is outputted from the encoder sensor E0004 accompanied by the movement of the carriage M4001. That output signal is outputted to the main PCB E0014 through the flexible flat cable (CRFFC) E0012.

The main PCB E0014 is a print PCB unit that manages a drive control of each section of the above described recording apparatus. The main PCB E0014 includes a PE sensor (sheet end sensor) E0007, an ASF (sheet feed) sensor E0009, and a cover sensor E0022 on the PCB. The main PCB E0014 includes an I/O port for a parallel I/F E0016, a serial I/F E0017, a resume key E0019, an LED E0020, a power key E0018, and a buzzer E0021. Further, the main PCB E0014 is connected to a carriage (CR) motor E0001, a conveyance (LF) motor E0002, a recovery (PG) motor E0003, and a sheet feed (ASF) motor E0023, and controls the driving of these parts. Further, the main PCB E0014 includes the ink end sensor E0006, a GAP sensor E0008, and a recovery (PG) sensor E0010. Further, the main PCB E0014 includes the carriage flexible flat cable (CRFFC) E0012 and an interface connecting with the power supply unit E0015.

Figure 5:
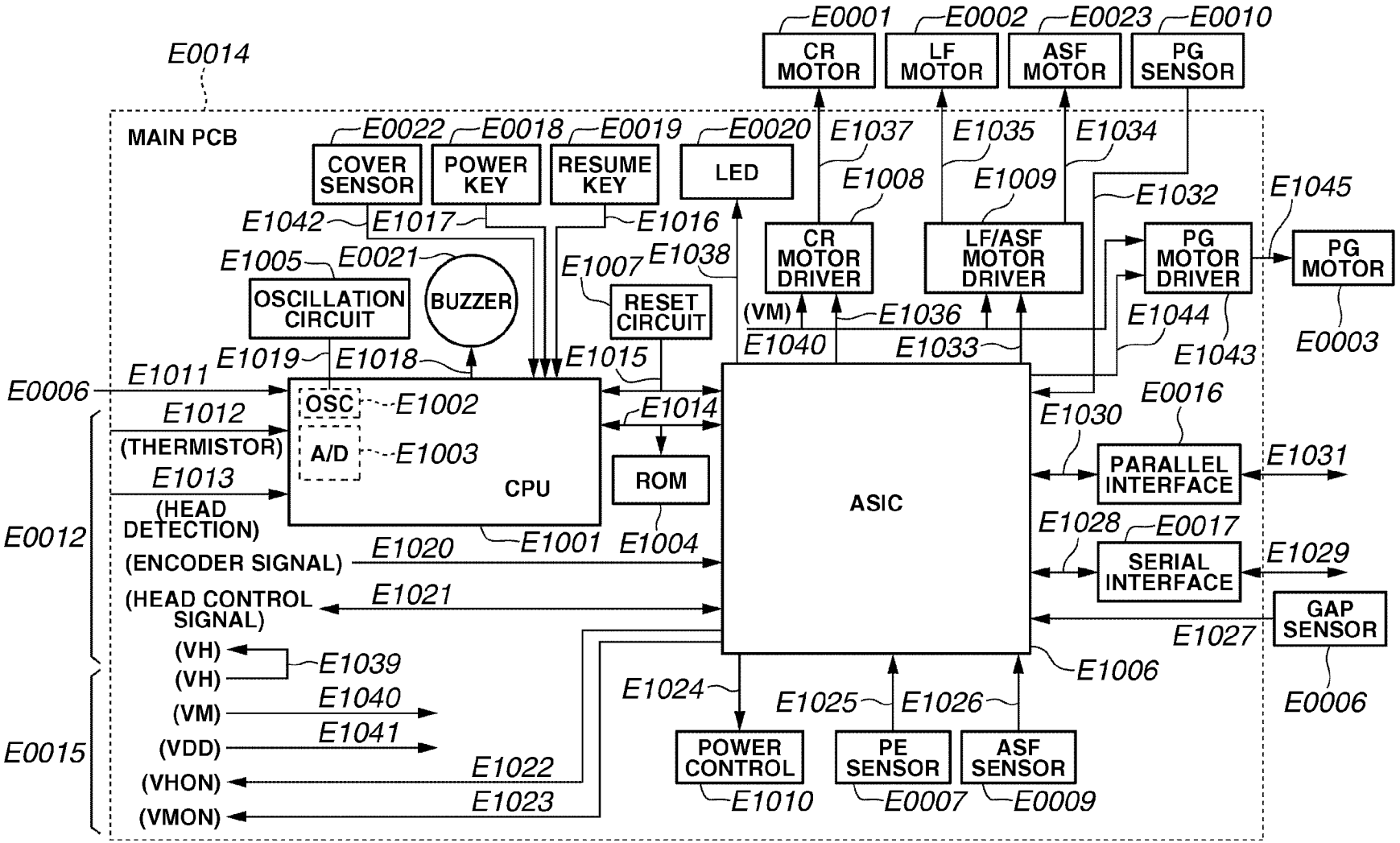
FIG. 5 is a block diagram showing a configuration of a main PCB (printed circuit board) of an electrical circuit of FIG. 4.

FIG. 5 is a block diagram showing a configuration of the main PCB E0014 of an electrical circuit of FIG. 4. In FIG. 5, a CPU E1001 includes an oscillator (OSC) E1002. The oscillator E1002 is connected to an oscillation circuit E1005 by an output signal E1019, and generates a system clock. Further, the CPU is connected to a ROM E1004 and an ASIC (Application Specific Integrated Circuit) E1006 through a control BUS E1014. Further, the CPU E1001 performs a control of the ASIC E1006 according to the program stored in the ROM E1004.

The CPU E1001 detects an input signal E1017 from the power key E0018 and an input signal E1016 from the resume key E1019 according to the program stored in the ROM E1004. The CPU E1001 detects a state of a detection signal E1042 from the cover sensor E0022 and the head detection signal (HSENS) E1013. Further, CPU E1001 drives the buzzer E0021 by a buzzer signal (BUZ) E1018. Further, the CPU E1001 detects a state of an ink end detection signal (INKS) E1011 and a thermistor temperature detection signal (TH) E1012 connected to a built-in A/D converter E1003. Further, the CPU E1001 performs various theoretical calculations and condition judgment, and manages a driving control of the recording apparatus.

The head detection signal E1013 is a head mounting detection signal which is inputted from the head cartridge H1000 through the CRFFC E0012, the carriage PCB E0013 and the contact flexible print cable E0011. The ink end detection signal E1011 is an analogue signal outputted from the ink end sensor E0006. The thermistor temperature detection signal E1012 is an analogue signal from the thermistor provided on the carriage PCB E0013. The motor power supply (VM) E1040 is a driving source of the CR motor driver E1008. The CR motor driver E1008 generates a CR motor driving signal E1037 according to a CR motor control signal E1036 from the ASIC E1006, and drives the CR motor E0001.

The motor power supply E1040 is also a driving source of an LF/ASF motor driver E1009. The LF/ASF motor driver generates an LF motor driving signal E1035 according to a pulse motor control signal (PM control signal) E1033 from the ASIC E1006. In this manner, the LF motor E0002 is driven. Further, the LF/ASF motor driver E1009 generates an ASF motor driving signal E1034 which drives the ASF motor E0023. The motor power supply E1040 is a driving source of PG motor driver E1043, and generate a PG motor driving signal E1045 according to a pulse motor control signal (PM control signal) E1044 from the ASIC E1006, which drives the PG motor E0003.

A power control circuit E1010 controls a supply of power to each sensor having a light emitting element according to a power control signal E1024 from the ASIC E1006. The parallel I/F E0016 transfers a parallel I/F signal E1030 from the ASIC E1006 to a parallel I/F cable E1031, and transfers a signal from the parallel I/F cable E1031 to the ASIC E1006. The parallel I/F cable E1031 is connected to the outside. The serial I/F E0017 transfers a serial I/F signal E1028 from the ASCI E1006 to the serial I/F cable E1029, and transfers a signal of the serial I/F cable E1029 to the ASIC E1006. The serial I/F cable E1029 is connected to the outside.

From the power supply unit E0015, a head power supply (VH) E1039, a motor power supply (VM) E1040, and a logic power supply (VDD) E1041 are supplied. A head power supply ON signal (VHON) E1022 and a motor power supply ON signal (VMON) E1023 from the ASIC E1006 are inputted into the power supply unit E0015, and control ON/OFF of the head power supply (VH) E1039 and the motor power supply (VM) E1040, respectively. A logic power supply (VDD) E1041 supplied from the power supply unit E0015 is subjected to a voltage conversion as necessary, and then supplied to each section inside and outside of the main PBC E0014. The head power supply (VH) E1039 is smoothed in the main PCB E0014, and thereafter it is sent out to the CRFFC (carriage flexible flat cable) E0012 and is used for the driving of the head cartridge H1000.

A reset circuit E1007 detects a voltage dip of the logic power supply (VDD) E1041, supplies a reset signal (RESET) E1015 to the CPU E1001 and the ASIC E1006, and performs initialization. The ASIC E1006 is a semiconductor integrated circuit of one chip, and is controlled by the CPU E1001 through the control BUS E1014. According to this control, the ASIC E1006 outputs the CR motor control signal E1036, the PM control signal E1033, the power control signal E1024, the head power supply ON signal E1022, and the motor power supply ON signal E1023. The ASIC E1006 transmits and receives the signals from and to the parallel I/F E0016 and the serial I/F E0017.

The ASIC E1006, according to the control of the CPU E1001, detects states of a PE detection signal (PES) E1025 from the PE sensor E0007 and an ASF detection signal (ASFS) E1026 from the AS sensor E0009. Further, the ASIC E1006 detects states of a GAP detection signal (GAPS) E1027 from the GAP sensor E0008 and a PG detection signal (PGS) E1032 from the PG sensor E0010. The ASIC E1006 transfers data showing those states to the CPU E1001 through the control bus E1014. At the same time, based on the inputted data, the ASIC E1006 generates an LED driving signal E1038 and controls flashing of the LED E0020.

Further, the ASIC E1006 detects a state of an encoder signal (ENC) E1020 and generates a timing signal. Further, the ASIC E1006 interfaces with the head cartridge H1000 by a head control signal E1021, and controls an image forming operation. The encoder signal (ENC) E1020 is an output signal of the CR encoder sensor E0004, which is inputted through the CRFFC E0012. The head control signal E1021 is supplied to the recording head H1001 through the CRFFC E0012, the carriage PCB E0013, and the contact FPC E0011.

FIG. 6 is a block diagram showing a configuration of the ASIC E1006 of the main PCB E0014 shown in FIG. 5. In FIG. 6, as the connection between each block, only a flow of the data (e.g., a recording data or motor control data) is shown which relates to the control of the recording head and mechanical parts of each section. Namely, in FIG. 6, the control signal and a clock related to read and write of the resistors which are incorporated into each block, and the control signal related to direct memory access (DMA), are omitted for sake of simplicity.

A phase-locked loop (PLL) E2002 generates a clock, which is to be supplied to the major portion in the ASIC E1006 as a clock signal (CLK) E2031, and a PLL control signal (PLLON) E2033, which is outputted from the CPU E1001 of FIG. 5. A CPU I/F (CPU interface) E2001 operates based on a reset signal E1015, a soft reset signal (PDWN) E2032 outputted from the CPU E1001, the clock signal (CLK) E2031, and the control signal from the control BUS E1014. The CPU I/F E2002 controls reading and writing in the resistor of each block, supply of a clock to part of blocks, and acceptance of interrupt signals. Further, the CPU I/F E2001 outputs an interrupt signal (INT) E2034 to the CPU E1001, and informs the CPU E1001 of the generation of an interruption within the ASIC E1006.

A DRAM E2005, as a data buffer for recording, includes such areas as a reception buffer E2010, a work buffer E2011, a print buffer E2014, and a rasterization data buffer E2016. Further, the DRAM E2005 includes a motor control buffer E2023 for motor control. Further, the DRAM E2005, as a buffer used at the scanner operation mode time, includes areas such as a scanner capturing buffer E2024, a scanner data buffer E2026, and a transmission buffer E2028 in place of the above described recording data buffers. The DRAM E2005 is used also as a work area required for operation of the CPU E1001. A DRAM control section E2004 switches between the access to the DRAM E2015 from the CPU E1001 via the control BUS E1014 and the access to the DRAM E2005 from a DMA control section E2003. The DRAM control section E2004 also performs a read-write operation to the DRAM E2005.

The DMA control section E2003 receives a request from each block, and outputs an address signal, a control signal, and the like to the DRAM control section E204 to perform a DRAM access. In the case of the write operation, the DMA control section E2003 outputs write data and the like (E2038, E2041, E2044, E2053, E2055, and E2057) to the DRAM control section E2004 to perform a DRAM access. Further, the DMA control section E2003, in the case of reading, delivers read data (E2040, E2043, E2045, E2051, E2054, E2056, E2058, and E2059) from the DRAM control section E2004 to the block requesting the data.

A 1284 I/F E2006 performs a two-way communication interface with an external host equipment through the parallel I/F E0016 under control of the CPU E1001 through the CPU I/F E2001. The 1284 I/F, at the time of the recording operation, delivers a received data (PIF received data E2036) from the parallel I/F to the reception control section E2008 by the DMA processing. Further, the 1284 I/F E2006, at the time of scanner reading, transmits the data (1284 transmission data (RDPIF) E2059) stored in the transmission buffer E2028 within the DRAM E2005, to the parallel I/F E0016 by the DMA processing.

A USB I/F E2007 performs a two-way communication interface with the external host equipment through the serial I/F E0017 under a control of the CPU E1001 through the CPU I/F E2001. The USB I/F, at the printing time, delivers the received data (USB received data E2037) from the serial I/F to the reception control section E2008 by the DMA processing. Further, the USB I/F E2007, at the scanner reading time, transmits the data (USB transmit data (RDUSB)) E2058 stored in the transmission buffer E2028 within the DRAM E2005, to the serial I/F E0017 by the DMA processing. The reception control section E2008 writes the received data (WDIF) E2038 from the I/F that is selected from one of the 1284 I/F E2006 and USB I/F E2007, in a reception buffer write address that the reception buffer control section 2039 manages.

A compression-expansion DMA E2009 reads the received data (raster data) stored on the reception buffer E2010, from the reception buffer read address managed by the reception buffer control section 2039 under control of the CPU E1001 through the CPU I/F E2001. The compression-expansion DMA E2009 compresses and expands this read received data (RDWK) E2040 according to a designated mode, and writes it in the work buffer area as a recording code row (WDWK) E2041. A recording buffer transfer DMA E2013 reads a recording code (RDWP) E2043 in the work buffer E2011 under control of the CPU E1001 through the CPU I/F E2001. Then, the recording buffer transfer DMA E2013 re-arranges each recording code to the address on the print buffer E2014 so that the recording data becomes suitable for the transfer sequence of the data sent to the head cartridge H1000, and then transfers the recording code (WDWP (E2044)).

A work clear DMA E2012 repeatedly writes a designated work field data (WDWF) E2042 in the area of the work buffer E2011 where the transfer by the recording buffer transfer DMA (E2013) is completed under control of the CPU E1001 through the CPU I/F E2001. The recording data rasterization DMA E2015 triggers a data rasterization timing signal E2050 from a head control section E2018 under control of the CPU E1001 through the CPU I/F E2001. The recording data rasterization DMA E2015 reads the recording code, which is arranged and written on the print buffer E2014, and a rasterization data written on the rasterization data buffer E2016. Further, based on the rasterization data, the recording data rasterization DMA E2015 generates a rasterization recording data (RDHDG) E2045, and writes this data in a column buffer E2017 as a column buffer write data (WDHDG) E2047.

The column buffer E2017 is an SRAM for temporarily storing transfer data (rasterization recording data) which is sent to the head cartridge H1000, and is jointly managed by the recording data rasterization DMA E2015 and the head control section E2018 with a handshake signal between both blocks. The head control section E2018 interfaces with the head cartridge H1000 or a scanner by the head control signal E1021 under control of the CPU E1001 through the CPU I/F E2001. Further, the head control section E2018, based on a head driving timing signal E2049 from the encoder signal control section E2019, outputs a data rasterization timing signal E2050 to the recording data rasterization DMA E2015.

The head control section E2018, at the time of an image formation (printing), reads a rasterization recording data (RDHD) E2048 from the column buffer E2017 according to the head driving timing signal E2049. The head control section E2018 outputs this data as the head control signal E1021 to the cartridge H1000. Further, the head control section E2018 DMA-transfers, in a scanner reading mode, the captured data (WDHD) E2053 inputted through the head control section E2018 to the scanner capturing buffer E2024 in the DRAM E2005.

A scanner data processing DMA E2025 reads a captured buffer read data (RDAV) E2054 stored in the scanner capturing buffer E2024 under control of the CPU E1001 through the CPU I/F E2001. The captured buffer read data (RDAV) E2054 is subjected to processing such as averaging, and the scanner data processing DMA E2025 writes the thus processed data (WDAV) E2055 in the scanner data buffer E2026 on the DRAM E2005. A scanner data compressing DMA E2027 reads a processed data (RDYC) E2056 in the scanner data buffer E2026 under control of the CPU E1001 through the CPU I/F E2001, and performs data compression. The scanner data compressing DMA E2027 writes this compressed data (WDYC) E2057 in the transmission buffer E2028 and transfers it.

The encoder signal control section E2019, upon receipt of the encoder signal (ENC) E1020, outputs a head driving timing signal E2049 according to the mode set by a control of the CPU E1001. Further, the encoder signal control section E2019 stores the information related to the position and velocity of the carriage M4001 obtained from the encoder signal E1020 in a resister, and supplies this information to the CPU E1001. The CPU E1001, based on this information, decides various parameters for control of the CR (carriage) motor E0001. A CR (carriage) motor control section E2020 outputs the CR moor control signal E1036 to the CR motor driver E1008 under control of the CPU E1001 through the CPU I/F E2001.

A sensor signal processing section E2022 receives each of the detection signals (E1032, E1025, E1026, and E1027) outputted from the PG sensor E0010, PE sensor E0007, ASF sensor E0009, and GAP sensor E0008. The sensor signal processing section E2022 transfers these pieces of sensor information to the CPU E1001 according to the mode that is set under control of the CPU E1001. In addition, the sensor signal processing section E2022 outputs a sensor detection signal E2052 to an LF/ASF motor control section (motor control DMA) E2021.

The LF/ASE motor control DMA E2021 and the PG motor control DMA E2059 operate under control of the CPU E1001 through the CPU I/F E2001. In this operation, a pulse motor driving table (RDPM) E2051 is read from the motor control buffer E2023 in the DRAM E2005, and the pulse motor control signals (E1033 and E1044) are outputted. Further, the LF/ASF motor control DMA E2021 and PG motor control DMA E2059 receive the sensor detection signals as a trigger of control and outputs pulse motor control signals (E1033 and E1044), depending on the operation mode.

An LED control section E2030 outputs the LED driving signal E1038 under control of the CPU E1001 through the CPU I/F E2001. A port control section E2029 outputs the head power supply ON signal E1022, the motor power supply ON signal E1023, and the power control signal E1024 under control of the CPU E1001 through the CPU I/F E2001.

Figure 7:
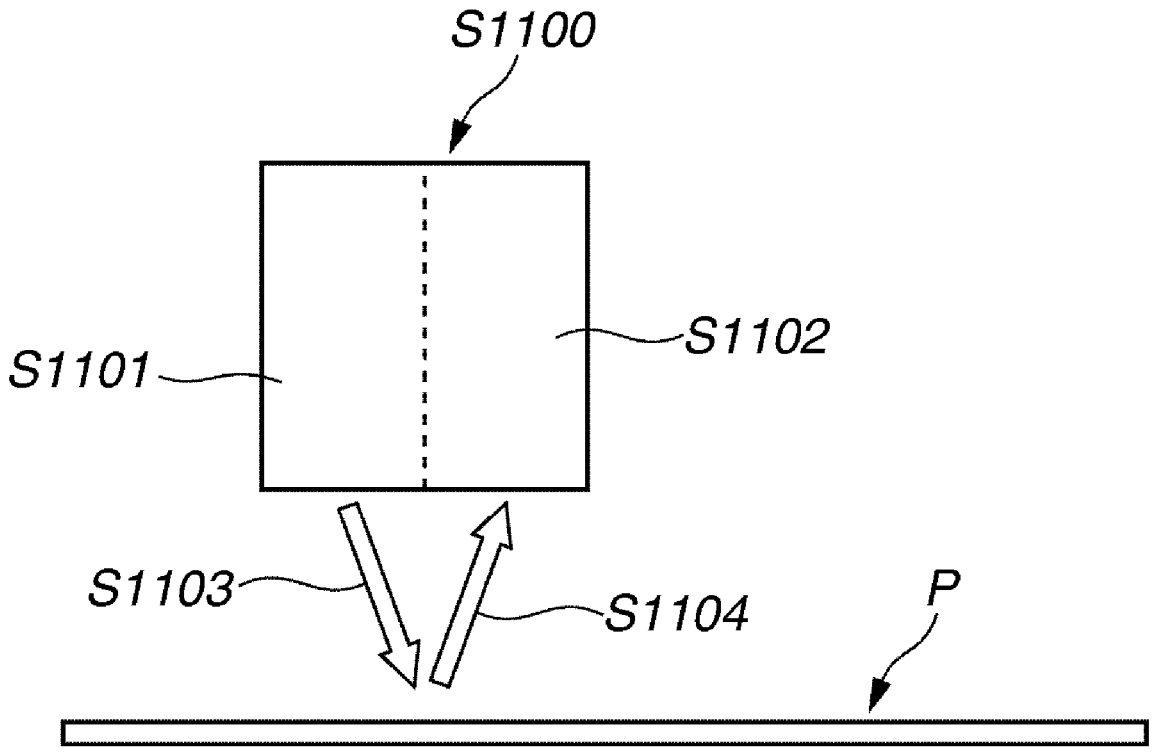
FIG. 7 is a schematic view showing a reflective optical sensor used in the recording apparatus according to the present embodiment.

FIG. 7 is a schematic view of a reflective optical sensor S1100 used in the recording apparatus according to the present embodiment. The optical sensor S1100 constitutes a second detection unit, and as shown in FIG. 4, is attached to the carriage M4001. In FIG. 7, the optical sensor S1100 includes a light emitting section S1101 and a light receiving section S1102. Light S1103 emitted from the light emitting section S1101 is reflected on a recording sheet P, and the reflected light S1104 is detected by the light receiving section S1102. The detection signal from the light receiving section S1102 is transferred to a control circuit formed on a main PBC E0014 of the apparatus main body through a flexible cable (CRFFC) E0012, and is converted into a digital signal by an A/D converter within the control circuit.

The optical sensor S1100, used in the present embodiment, can be a reflective sensor working outside of a visible area which is immune from ink mist and the outside light. However, in a case where the reflective sensor is used also for performing an alignment adjustment of each dot, a sensor working in a visible light area is used. In this case, a threshold value can be set so that sufficient output can be produced to cope with disturbances. Also, in this case, adherence of the splash of the ink and the like can be prevented by arranging the position of the optical sensor S1100 at a position shifted from the discharging port of the recording head H1001 in the conveyance direction of the recording sheet.

Figure 9:
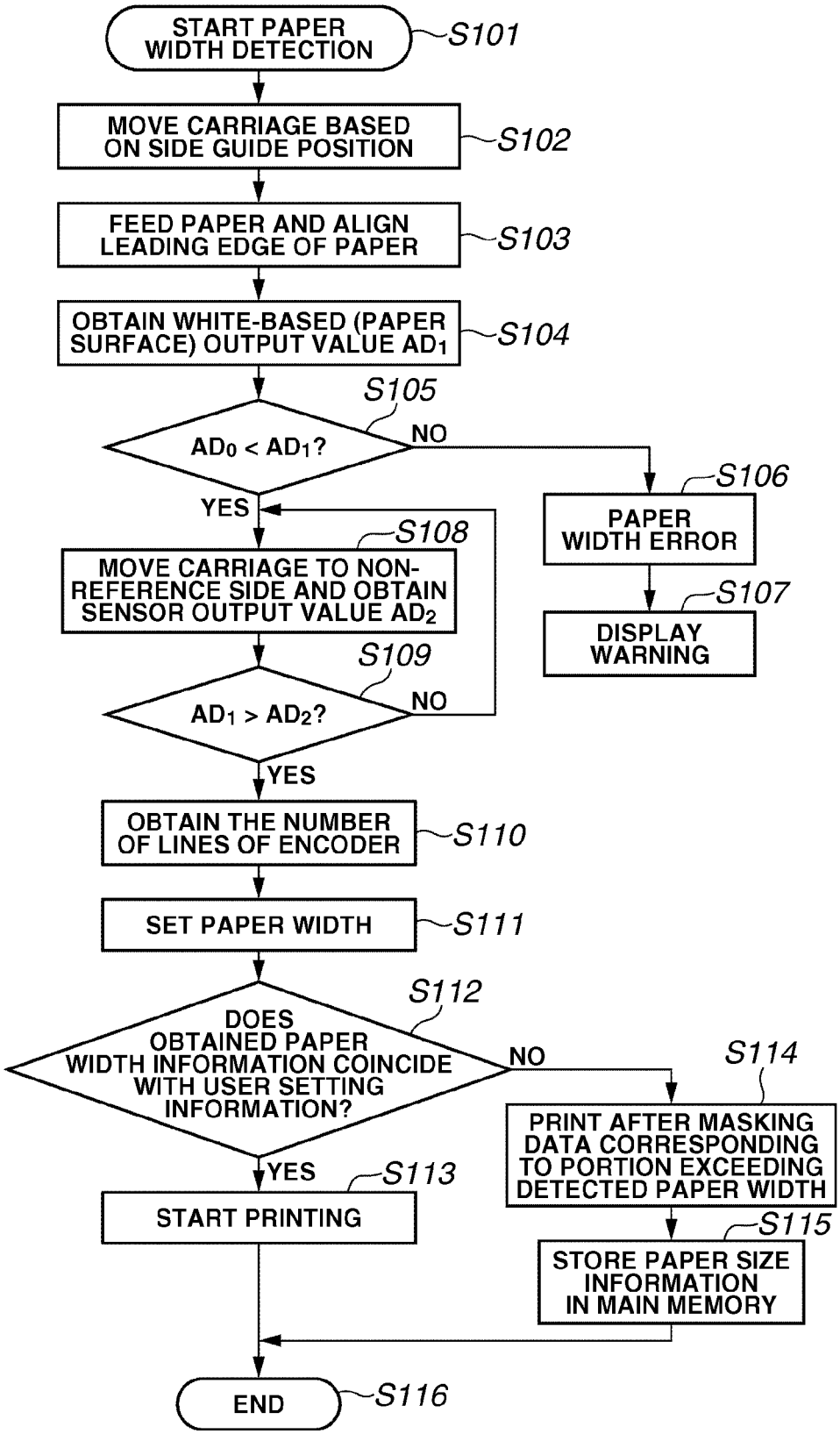
FIG. 9 is a flowchart showing one example of the sequence when the width of the recording sheet is detected according to the embodiment of the present invention.

FIG. 9 is a flowchart showing one example of the sequence when detecting the sheet width of the recording sheet in the present embodiment. In FIG. 9, at step S101, the sheet width detection starts. First, an edge on one side of a sheet (recording sheet) P is fitted to a reference side guide M3024*a*, and at the same time, a movable side guide M3024*b* is loaded in a state in which it is fitted to the edge on the other side of the sheet. In this state, the position of the movable side guide M3024*b* is detected by a sensor (i.e., the first detection unit) arranged between the base section M3023 and the pressure plate M3025.

In the present embodiment, the sensors are arranged at three places in the sheet width direction, and as shown in FIG. 8, four sheet width areas (positions) indicated by W1, W2, W3, and W4 can be detected. Next, at step S102, the carriage M4001 is moved so that the optical sensor S1100 (i.e., a second detection unit) is positioned away from the edge of the assumed sheet width to the reference side (at the side of the reference side guide M3024*a*). With this configuration, rough sheet width information can be obtained from the positional information about the movable side guide M3024*b* in a sheet loading section of the sheet feed section M3022. In this case, as shown in FIG. 8, the sheet width is specified for each group of sheet types W1 to W4. Here, it is assumed that the sheet type of the detected sheet is W1 as shown in FIG. 8. The sheet type W1 corresponds to the width of B5 to letter size.

In the present embodiment, in consideration of cutting errors of the sheet as well as setting errors of the movable side guide M3024*b*, W1 is set to be detectable in the range of 175 mm to 220 mm from a set reference position (reference side guide M3024*a*) of the recording sheet. Hence, the carriage M4001 is moved and stands by so that the reflective optical sensor S1100 (i.e., the second detection unit) is positioned at a predetermined distance to the reference side position. The second detection unit is placed at a position of approximately 170 mm in the present embodiment instead of the minimum sheet width 175 mm.

Next, at step S103, the sheet is fed and leading edge is aligned. When the alignment of the leading edge is completed, the leading edge of the sheet reaches the detection section of the optical sensor S1100 in relation to the sheet feed direction. At step S104, an output value AD1 at the sheet surface is obtained by the optical sensor S1100. At step S105, it is determined whether the output value AD1 is higher than an initial setting threshold value AD0 for the sheet detection by the optical sensor S1100. In a case where the output value AD1 is smaller than or equal to the initial setting threshold value AD0, no sheet is present at this position. Consequently, in this case, the position of the movable side guide M3024*b* is set at an inappropriate position with respect to the sheet width. Then, as a sheet width error, the processing proceeds to step S106, and at step S107, a warning is displayed to the user to that effect. On the other hand, in a case where AD0<AD1, the sheet exists at the position and is in a state in which the sheet width can be detected, and the processing proceeds to the next step S108.

At step S108, the carriage M4001 is moved to a non-reference side, and an output value AD2 of the sensor S1100 is obtained. Then, AD2 and AD1 are compared (step S109). The place where AD2=AD1 changes to AD2<AD1, is a position corresponding to the side edge of the recording sheet. The processing proceeds to step S110, and the position of the carriage M4001 at the time when AD2 becomes smaller than AD1, is obtained by the number of lines of the encoder. In this manner, an actual edge position of the recording sheet is detected by the second detection unit, and the width of the recording sheet, which is set, can be accurately detected. Accuracy with which to detect sheet width is approximately equal to the resolution of the encoder. In the present embodiment, since the encoder of 150 LPI is used, the sheet width information can be obtained in units of 0.17 mm.

Next, at step S111, the user sets sheet width. Then, at step S112, the sheet width information obtained at step S110 and the information set by the user are compared. In a case where the information set by the user coincides with the obtained sheet width information, or the obtained sheet width information is larger than the information set by the user, the processing proceeds to step S113, and the recording starts. In a case where the detected sheet width is smaller than the sheet width set by the user, the processing proceeds to step S114, and a warning is issued to the user. At the same time, the printing operation is performed after masking the printing data corresponding to a portion exceeding the detected sheet width. At step S115, the detected sheet size is stored in the memory of the recording apparatus main body. At step S116, a series of the operations for sheet width detection in the recording operation are completed.

If the sheet size detected at step S115 is stored and the setting of the movable side guide M3024*b* is not changed at the next printing time, the warning to the user, the generation of the printing data, and the printing operation are executed based on the sheet width information detected at the last time. According to the above described embodiment, the width of the loaded recording sheets is detected, and the recording sheets are roughly divided into groups. Then, the minimum are a required for the operation is detected by the sensor mounted on the carriage M4001 so as to determine the sheet width size precisely. Therefore, an accurate sheet width of the recording sheet can be detected in a short period of time and reduction of throughput can be lessened. In addition, an exceeding printing is avoided in the area where there is no recording sheet, and smearing inside the recording apparatus main body is prevented.

Further, at the next printing operation time, an attention of the user is called based on the detected sheet width information, so that the printing data having no defect and an appropriately set number of columns can be generated. Further, since the first detection unit can detect a position of the member configures to control the width of the loaded recording sheets, a highly reliable apparatus of a relatively simple structure can be provided. Further, since the second detection unit is a reflective sensor of the non-contact type, the effect on the recording sheets can be reduced in comparison with the contact type. Further, in the recording apparatus including a plurality of recording sheet supply ports, it is possible to supply the recording sheets of the most appropriate size. Hence, even if the recording sheets are recognized as belonging to the same group by the first detection unit, the recording sheets are detected again in detail by the second detection unit. Additionally, the information obtained is fed back, so that a subsequent supply of recording sheets is performed more accurately.

FIG. 10 is a flowchart showing another sequence in a case where the width of the recording sheet is detected in the present embodiment. In the sequence of FIG. 10, before the sheet width is detected, detection is made as to whether the sheet feed operation has been normally performed using the sheet width sensor. In FIG. 10, at step S201, the sheet width detection is started. First, the recording sheets are loaded in a state in which the edge on one side of the sheet (recording sheet) P is fitted to the reference side guide M3024*a*. At the same time, the movable side guide M3024*b* is fitted to the other side of the sheet. In this state, by the sensor (i.e., the first detection unit) arranged between the base section M3023 and the pressure plate M3025, the position of the movable side guide M3024*b* is detected.

Also in the present embodiment, the sensors are arranged at three places in the sheet width direction, and as shown in FIG. 8, four sheet width areas (positions) indicated by W1, W2, W3, and W4 can be detected. Next, at step S202, the carriage M4001 is moved so that the optical sensor S1100 (i.e., the second detection unit) is positioned away from the edge of the assumed sheet width to the reference side (to the side of reference guide M3024*a*). With this configuration, rough sheet width information can be obtained from the positional information about the movable side guide M3024*b* in a sheet loading section of the sheet feed section M3022. In this case also, as shown in FIG. 8, the sheet width is specified for each group of sheet types W1 to W4. As described in FIG. 8, it is also assumed that the movable side guide M3024*b* is detected to be positioned at W1, by the first detection unit.

Also in the present embodiment, in consideration of cutting errors of the sheet as well as setting errors of the movable side guide M3024*b*, W1 is set to be detectable in the range of 175 mm to 220 mm from a set reference position (for example, reference side guide 3024*a*) of the recording sheet. Hence, the carriage M4001 is moved and stands by so that the reflective optical sensor S1100 (i.e., the second detection unit) is positioned at a predetermined distance to the reference side position. The second detection unit is placed at a position of approximately 170 mm in the present embodiment instead of the minimum sheet width 175 mm. Next, at step S203, an output value AD00 of the optical sensor S1100 is obtained where a sheet is not present.

Subsequently, at step S204, the sheet is fed and the leading edge is aligned. When the alignment of the leading edge is completed, the leading edge of the recording sheet reaches the detection section of the optical sensor S1100 in relation to the sheet feed direction. At step S205, an output value AD1 at the sheet surface is obtained by the optical sensor. At step S206, it is determined whether the output value AD1 is higher than an output value AD00 where a sheet is not present for the optical sensor. In a case where the output value AD1 is smaller than or equal to the output value AD00, no sheet is present at this position. In this manner, it can be determined that either the position of the movable side guide M3024*b* is set at a too inappropriate position with respect to the sheet width, or there is the possibility that a sheet jam occurs between the PE lever M3020 and the optical sensor S1100 where the sheet feed is not normally operated. In a case where the output value AD1 is smaller than or equal to the output value AD00, the procedure proceeds to step S207. The carriage M4001 is moved to the sheet width reference side (side of the reference side guide 3024*a*), and a sensor output value AD02 is obtained.

At step S208, the sensor output value AD02 is compared with the output value AD00 at the time when a sheet is not present. If AD00≧AD02, a sheet is not present even at the sheet width reference side, and there is a possibility that a sheet jam occurs. Therefore, the processing proceeds to step S211, and jamming error is displayed. On the other hand, at step S208, if it is determined that AD00<AD02, there exists a recording sheet and the sheet width can be detected. Therefore, the processing proceeds to step S209. At step S209, the carriage M4001 is moved to a non-reference side, and the output value AD2 of the sensor S1100 is obtained. Then, the processing proceeds to S210, and AD1 and AD2 are compared.

On the other hand, at step S206, in a case where the result of comparison between the output value AD00 and the output value AD1, is AD00<AD1, the sheet width can be detected. Accordingly, the processing proceeds to step S212. At step S212, the carriage M4001 is also moved to the non-reference side, and the output value AD2 of the sensor S1100 is obtained. At step S213, AD2 is compared with AD1. The place where AD2=AD1 changes to AD2<AD1, is a position corresponding to the side edge of the recording sheet. Consequently, in the case where the result of comparing AD2 and AD1 at steps S210 and S213 is AD2<AD1, the processing proceeds to step S214, and the position of the carriage M4001 at the time when AD2 becomes smaller than AD1, is obtained from the number of lines of the encoder.

By detecting the actual edge position of the recording sheet in this manner, the width of the recording sheet which is set, can be accurately detected. Accuracy with which to detect sheet width, is approximately equal to the resolution of the encoder. In the present embodiment, since the encoder of 150 LPI is used, the sheet width information can be obtained in units of 0.17 mm.

Next, at step S215, the user sets sheet width. Then, at step S216, the sheet width information obtained at step S214 and the information set by the user are compared. In a case where the information set by the user coincides with the obtained sheet width information (detected width information), or the obtained sheet width information is larger than the information set by the user, the processing proceeds to step S219, and the recording starts. In a case where the detected sheet width is smaller than the sheet width set by the user, the processing proceeds to step S217, and a warning is issued to the user. At the same time, the printing operation is performed after masking the printing data corresponding to a portion exceeding the detected sheet width. At step S218, the detected sheet size is stored in the memory of the recording apparatus main body. At step S220, a series of operations for sheet width detection and sheet jam detection in the recording operation are completed.

In the processing of FIG. 10, the sheet size detected at step S218 is also stored. If the setting of the movable side guide M3024*b* is not changed at the next printing time, the warning to the user, the generation of the printing data, and the printing operation are executed based on the sheet width information detected at the last time. Consequently, according to the embodiment of FIG. 10, the same effect as the embodiment of FIG. 9 can be obtained. That is, the sheet width of the recording sheet can be accurately detected in a short period of time and reduction of throughput can be lessened. In addition, an exceeding printing is avoided in the area where no recording sheet is present, and smearing inside the apparatus main body can be prevented. Further, at the next printing operation time, an attention of the user is called based on the detected sheet width information, so that the printing data having no defect and an appropriately set number of columns, can be generated. Further, by detecting the leading edge alignment of the recording sheet, it can be also detected whether the sheet feed operation is normally operated, and reliability of the apparatus can be improved.

In the above described embodiments, as an example, the inkjet recording apparatus is described which performs recording by discharging the ink from the recording head. However, the present invention can be similarly applied to the recording apparatuses of other recording methods such as a laser beam method, a heat-transfer method, a thermal method, or a wire-dot method. Further, the present invention can be applied regardless of the number of recording heads to any recording apparatus, independently whether the recording apparatus uses one piece of the recording head, or a plurality of recording heads for different color inks. Further, the present invention is similarly applied to the recording apparatus using a plurality of recording heads for the ink of the same color of different density, or the recording apparatus that combines the recording heads of these types.

According to the recording apparatus of the embodiments of the present invention, the sheet width can be accurately detected by a simple structure in a short period of time, so that reliability of the apparatus can be improved.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2005-290008 filed Oct. 3, 2005, which is hereby incorporated by reference herein in its entirety.

What is claimed is:

1. A recording apparatus comprising:

a carriage mounting a recording head thereon and moving along a surface of a recording sheet at least in a width direction;

a plate configured to load recording sheets;

a base section configured to support the plate;

a reference side guide configured to set a reference position for the recording sheet loaded on the plate in the width direction;

a movable side guide arranged on the plate movably in the width direction and configured to set positions of the recording sheets loaded on the plate in the width direction in company with the reference side guide;

a first detection unit configured to detect roughly a position of the movable side guide from a plurality of predetermined positions in the width direction;

a second detection unit including an optical sensor provided on the carriage, configured to detect precisely an end position of a recording sheet in the width direction, fed one by one from the recording sheets loaded on the plate, while the carriage moves in the width direction; and a control unit configured to control the apparatus, wherein the control unit determines a limited detection area of the second detection unit in accordance with the detected predetermined position of the movable side guide detected by the first detection unit, and the end position of the recording sheet is detected when outputs of the optical sensor change while the carriage moves in the limited detection area; and wherein the control unit further determines a position error of the movable side guide by steps of: a first step to feed the recording sheet; a second step to detect the recording sheet fed in the first step by the optical sensor at a position that is closer to the reference position than the detected predetermined position in the width direction; and a third step to determine the position error in a case where no recording sheet has been detected in the second step.

2. The recording apparatus according to claim 1, wherein the second detection unit includes a reflective optical sensor of a non-contact type.

3. The recording apparatus according to claim 1, wherein the existence of the fed recording sheet is detected based on the width of the recording sheet detected by the second detection unit.

4. The recording apparatus according to claim 1, wherein a position of the recording sheet is detected by moving the carriage according to the width of the recording sheet detected by the second detection unit.

5. The recording apparatus according to claim 1, wherein the first detection unit comprises a plurality of sensors arranged in the width direction, each sensor corresponding to the plurality of the predetermined positions.

6. A recording apparatus according to claim 1, wherein the first position is slightly closer to the reference position from the detected predetermined position and the second position is in proximity to the reference position.

7. A recording apparatus according to claim 1, wherein the end position of the recording sheet is detected when outputs of the optical sensor change while the carriage moves away from the reference position in the limited detection area.

8. A recording apparatus comprising:

a carriage mounting a recording head thereon and moving along a surface of a recording sheet at least in a width direction;

a plate configured to load recording sheets;

a base section configured to support the plate;

a reference side guide configured to set a reference position for the recording sheet loaded on the plate in the width direction;

a movable side guide arranged on the plate movably in the width direction and configured to set positions of the recording sheets loaded on the plate in the width direction in company with the reference side guide;

a first detection unit configured to detect roughly a position of the movable side guide from a plurality of predetermined positions in the width direction;

a second detection unit, including an optical sensor provided on the carriage, configured to detect precisely an end position of a recording sheet in the width direction fed one by one from the recording sheets loaded on the plate, while the carriage moves in the width direction; and a control unit configured to control the apparatus, wherein the control unit determines a limited detection area of the second detection unit in accordance with the detected predetermined position of the movable side guide detected by the first detection unit, and the end position of the recording sheet is detected when outputs of the optical sensor change while the carriage moves in the limited detection area, and wherein the control unit further determines a paper jam by steps of: a first step to feed the recording sheet; a second step to detect the recording sheet fed in the first step by the optical sensor at a first position; a third step to detect, in a case where no recording sheet has been detected in the second step, the recording sheet by the optical sensor at a second position which is closer to the reference position than the first position in the width direction; and a fourth step to determine the paper jam in a case where no recording sheet has been detected in the third step.

9. A recording apparatus according to claim 8, wherein the first position is slightly closer to the reference position from the detected predetermined position and the second position is in proximity to the reference position.

10. A recording apparatus according to claim 8, wherein the end position of the recording sheet is detected when outputs of the optical sensor change while the carriage moves away from the reference position in the limited detection area.

* * * * *